US006403550B1

(12) United States Patent
Bolmer et al.

(10) Patent No.: US 6,403,550 B1
(45) Date of Patent: Jun. 11, 2002

(54) COMPOSITIONS BASED ON 142

(75) Inventors: Michael S. Bolmer, Lower Providence, PA (US); Pascal Michaud, Saint-Gratien (FR)

(73) Assignee: ATOFINA Chemicals, Inc., Philadelphia, PA (US)

( * ) Notice: Subject to any disclaimer, the term of this patent is extended or adjusted under 35 U.S.C. 154(b) by 0 days.

(21) Appl. No.: 09/523,394

(22) Filed: Mar. 10, 2000

(51) Int. Cl.[7] ..... C11D 7/50

(52) U.S. Cl. ..... 510/410; 510/408; 510/411; 510/412; 510/415; 521/50

(58) Field of Search ..... 510/175, 176, 510/177, 407, 408, 410, 411, 412, 415, 202, 365; 134/40, 42, 38; 521/50

(56) References Cited

U.S. PATENT DOCUMENTS

| | | | | |
|---|---|---|---|---|
| 4,086,179 | A | * | 4/1978 | Schneider |
| 4,886,727 | A | * | 12/1989 | Anschel et al. |
| 5,268,121 | A | | 12/1993 | Michaud ..... 510/177 |
| 5,395,859 | A | * | 3/1995 | Demmin et al. |
| 5,478,492 | A | * | 12/1995 | Barthelemy et al. |
| 5,716,541 | A | * | 2/1998 | Wener et al. |

* cited by examiner

*Primary Examiner*—Yogendra N. Gupta
*Assistant Examiner*—Gregory E. Webb
(74) *Attorney, Agent, or Firm*—William D. Mitchell

(57) ABSTRACT

Azeotropic and azeotrope-like compositions of 142/365 mfc, 142/methanol, and 142/365 mfc/methanol are provided, as are methods for using the same for cleaning, drying, foam blowing and the like.

10 Claims, No Drawings

COMPOSITIONS BASED ON 142

BACKGROUND OF THE INVENTION

This invention relates to azeotropic or azeotrope-like compositions containing 1-chloro-2,2-difluoroethane ("HCFC-142" or "142") which can be used in various applications such as the cleaning, drying, degreasing and dry cleaning of solid surfaces (particularly defluxing and cold cleaning of printed circuits), in aerosol applications, and as foam blowing agents, particularly to such compositions wherein the 142 is blended with methanol, 1,1,1,3,3-pentafluorobutane ("HFC-365 mfc" or "365 mfc" or "365") or mixtures thereof.

1,1,2-Trichloro-1,2,2-trifluoroethane ("113") and 1,1,1-trichloroethane ("140a") have been widely used in industry as cleaning solvents for many years. However, they have been suspected to cause depletion of the stratospheric ozone layer and were banned by the Montreal Protocol. 1,1-Dichloro-1-fluoroethane ("141b") has been used to replace these solvents, as well as being widely used as a foam blowing agent, but it, too, is being banned because of its relatively high ozone depletion potential ("ODP"). These three solvents were used, among other things, for metal degreasing, removing solder flux from electronic components, and precision cleaning of sensitive equipment, such as gyroscopes. Their boiling points made them useful for aerosol or cold cleaning. Solvents proposed to replace these are often flammable (such as the 365/methanol mixtures of U.S. Pat. No. 5,268,121) or have low solvent power (such as perfluoro- carbons). It would thus be useful to find replacements which avoid these problems.

As used in this application, the term "azeotrope-like compositions" refers to mixtures or blends of generally miscible chemical compounds which boil at a substantially constant temperature while at the same time remaining substantially the same composition. When heated to reflux, such an azeotrope-like composition is in equilibrium with a vapor phase whose composition is substantially the same as that of the liquid phase. Such behavior is desirable to ensure satisfactory functioning of the machines in which cleaning operations are carried out, such as recycling by distillation.

BRIEF SUMMARY OF THE INVENTION

Herein provided, among other things, are azeotropic or azeotrope-like compositions comprising, on a weight basis, (a) about 50–90% of 142 with about 50–10% of 365 (preferably 60–80% of 142 with 40–20% of 365); (b) about 91–99.5% of 142 with about 9–0.5% of methanol (preferably 93–99% of 142 with 7–1% of methanol); and (c) about 50–75% of 142 with about 25–45% of 365 and about 0.5–10% of methanol (preferably 55–65% of 142 with 30–40% of 365 and 1–7% of methanol), methods for using the same for cleaning or drying of solid surfaces or as a foam blowing agent, specific azeotropic compositions of the foregoing mixtures (about 71.5% of 142 and about 28.5% of 365, which composition has a boiling point of about 35.4° C. at normal atmospheric pressure (about 1.013 bar); about 95.9% of 142 and about 4.1% of methanol, which composition has a boiling point of about 34.7° C. at normal atmospheric pressure; and about 62% of 142 plus about 3.6% of methanol and about 34.4% of 365, which composition has a boiling point of about 33.9° C. at normal atmospheric pressure), and the like.

DETAILED DESCRIPTION

Azeotropic and azeotrope-like compositions of 142 with 365, methanol or mixtures thereof have now been identified which solve many of the foregoing problems. The ODP of 142 is 0.02, compared to 0.8, 0.1 and 0.1 for 113, 140a, and 141b, respectively. HFC-365 and methanol have a zero ODP. Furthermore, these compositions have no flash point (using standard determination conditions, ASTM standard D 3828), making them safer for their intended use.

The inventive compositions can be readily prepared by simple mixing of the constituents.

As with prior cleaning compositions based on 113 or 141b, the cleaning compositions of this invention can, if so desired, contain stabilizers to protect against chemical attack resulting from their contact with water (hydrolysis), with light metals (constituting the solid surfaces to be cleaned) and/or against radical attacks liable to occur in the cleaning process. Exemplary of such stabilizers are nitroalkanes (such as nitromethane, nitroethane, or nitropropane), acetals (such as dimethoxymethane or dimethoxyethane) and ethers (such as 1,3-dioxolane or 1,4-dioxane). The proportion of stabilizer typically ranges from about 0.01 to about 5% based on the total weight of the composition. Dimethoxymethane is a preferred stabilizer.

The inventive compositions are particularly suitable for use in cleaning and degreasing of solid surfaces, particularly in defluxing of printed circuits, as well as in operations for drying surfaces, all according to conventional means, including aerosol application. They are useful as blowing agents for polyurethane foams, the foam formulation containing polyisocyanate, polyol and blowing agent and being made by conventional means. Other applications include use as refrigeration fluids and as dry-cleaning agents for textiles.

EXAMPLES

The examples which follow illustrate the invention without limiting it.

Example 1

Demonstration of Azeotropic Mixtures:

(A) 142/365 mfc:

100 Grams of 142 and 100 grams of 365 mfc were introduced into a boiling vessel of a distillation column having 30 plates. The mixture was then refluxed for one hour to bring the system to equilibrium. When a steady temperature was observed (34.7° C.), a fraction of about 10 grams was collected. Analysis of this fraction, as well as the tail fraction remaining in the vessel, by gas chromatography indicated the presence of an azeotropic composition of 71.5 weight % 142 and 28.5 weight % 365 mfc. This is a positive azeotrope since its boiling point is lower than that of the 142 (35.1° C.) and the 365 mfc (40° C.). The results were confirmed by rerunning the above experiment using an initial mixture having 71.5 weight % 142 and 28.5 weight % 365 mfc.

(B) 142/Methanol and 142/365 mfc/Methanol:

Following example 1(A), azeotropic compositions were found for 142/methanol and 142/365 mfc/methanol as indicated hereinabove.

Example 2

Composition Stabilized with Dimethoxymethane (Methylal)

150 Grams of a mixture containing by weight 28.5% of 365 mfc, 71% of 142 and 0.5% of methylal were introduced into a small ultrasound cleaning tank. After refluxing the system for one hour, an aliquot of the vapor phase was taken. Analysis, by gas chromatography, showed that the composition of the aliquot was the same as that of the initial mixture, indicating that the mixture is also stabilized in the vapor phase.

Example 3

Cleaning of Soldering Flux

The following test was carried out on five test circuits in accordance with Standard IPC-B-25 described in the test methods manual from IPC (Institute for Interconnecting and Packaging Electronic Circuits, Lincolnwood, Ill., USA): The circuits were coated with colophony-based soldering flux (product marketed by the Alphametal company under the name flux A 83 70112) and annealed in an oven at 220° C. for 30 seconds. To remove the colophony thus annealed, the circuits were cleaned using the 142/365 mfc/methanol azeotropic mixture in a small ultrasound machine for 3 minutes by immersion in the liquid phase and for 3 minutes in the vapor phase. Cleaning was evaluated according to the standardized IPC procedure 2.3.26 using a precise conductimeter. The value obtained, 2.32 $\mu g/cm^2$ eq. NaCl, is less than the ionic impurities threshold tolerated by the profession (2.5 $\mu g/cm^2$ eq. NaCl).

Example 4

Preparation of Polyurethane Foam:

Polyurethane foam having acceptable density (1.87 pounds/cubic foot) and K-factor (0.149 Btu.in/$ft^2$.h.F) was prepared by conventional techniques using as the blowing agent a mixture by weight of 78.5% 142 and 21.5% 365 mfc. More specifically, the foam formulation had an iso index of 250 and consisted of, in parts by weight: 100 parts T2541 (a polyester polyol available from Hoechst Celanese); 0.5 part PC-5 (an amine catalyst from Air Products); 0.74 part PC-46 (an isocyanurate catalyst from Air Products); 6.58 parts K-15 (a metal based catalyst from Air Products); 2 parts B-8457 (a polysiloxane-polyether copolymer surfactant from Goldschmidt Chemical); 0.5 part water; 8.08 parts 365 mfc; 20.27 parts 142; and 160.57 parts M489 (a polymeric methane diphenyl diisocyanate from Bayer Corporation). An "A" side premix was then made by mixing a predetermined amount of the M-489 and 66 weight % of the 142 and 365 mfc. Similarly, a "B" side premix was made by mixing a predetermined amount of polyol, catalysts, surfactant, water and 34 weight % of the 142 and 365 mfc. Predetermined amounts of the A and B sides were then mixed at 6,000 rpm for 10 seconds, followed by injection of catalyst mixture. The mixing was allowed to continue for an additional 10 seconds before pouring the mixture into a box. A one inch thick sample of the resulting foam was used for the k-factor measurement according to ASTM standard C518.

We claim:

1. Azeotropic or azeotrope-like compositions selected from the group consisting of blends comprising, on a weight basis, about 50–90% of 1-chloro-2,2-difluoroethane with about 50–10% of 1,1,1,3,3-pentafluorobutane; about 91–99.5% of 1-chloro-2,2-difluoroethane with about 9–0.5% of methanol; and about 50–75% of 1-chloro-2,2-difluoroethane with about 25–45% of 1,1,1,3,3-pentafluorobutan and about 0.5–10% of methanol.

2. A method for cleaning or drying a solid surface comprising applying an effective amount of a composition of claim 1 to said surface.

3. A polyurethane foam composition which comprises a mixture of a polyol, a polyisocyanate and an effective amount of a composition of claim 1 as the blowing agent.

4. A composition as in claim 1 comprising about 60–80% of 1-chloro-2,2-difluoroethane with about 40–20% of 1,1,1,3,3-pentafluorobutane.

5. A composition as in claim 1 comprising about 93–99% of 1-chloro-2,2-difluoroethane with about 7–1% of methanol.

6. A composition as in claim 1 comprising about 55–65% of 1-chloro-2,2-difluoroethane with about 30–40% of 1,1,1,3,3-pentafluorobutane and about 1–7% of methanol.

7. A composition as in claim 1 which further comprises about 0.01 to about 5 weight % of a stabilizer.

8. An azeotropic composition consisting essentially of, on a weight basis, about 71.5% of 1-,chloro-2,2-difluoroethane and about 28.5% of 1,1,1,3,3-pentafluorobutane, which composition has a boiling point of about 35.4° C. at normal atmospheric pressure.

9. An azeotropic composition consisting essentially of, on a weight basis, about 95.9% of 1-chloro-2,2-difluoroethane and about 4.1% of methanol which composition has a boiling point of about 34.7° C. at normal atmospheric pressure.

10. An azeotropic composition consisting essentially of, on a weight basis, about 62% of 1-chloro-2,2-difluoroethane, about 3.6% of methanol and about 34.4% of 1,1,1,3,3-pentafluorobutane, which composition has a boiling point of about 33.9° C. at normal atmospheric pressure.

* * * * *